US006481109B2

(12) United States Patent
Rarick et al.

(10) Patent No.: US 6,481,109 B2
(45) **Date of Patent: *Nov. 19, 2002**

(54) CONTROL SYSTEM FOR EYEGLASS TRACER

(75) Inventors: Kimber W. Rarick, Muskogee, OK (US); Don S. Wills, Broken Arrow, OK (US); Martin A. Moon, Tulsa, OK (US); Ryan J. Davis, Tulsa, OK (US); John T. Rathbone, Broken Arrow, OK (US)

(73) Assignee: National Optronics, Inc., Charlottesville, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/888,516

(22) Filed: Jun. 26, 2001

(65) Prior Publication Data

US 2001/0042313 A1 Nov. 22, 2001

Related U.S. Application Data

(63) Continuation of application No. 09/271,271, filed on Mar. 17, 1999, now Pat. No. 6,249,991.

(51) Int. Cl.[7] ..... B43L 11/00; A61B 3/10; B24B 9/14

(52) U.S. Cl. ..... 33/28; 33/200; 33/507; 33/551; 451/5; 451/43

(58) Field of Search ..... 451/5, 11, 43, 451/67, 240, 256; 33/28, 200, 507, 551, 553

(56) References Cited

U.S. PATENT DOCUMENTS

| | | | | |
|---|---|---|---|---|
| 659,778 A | 10/1900 | Weaver | ..... | 5/18.1 |
| 912,518 A | 2/1909 | Wilhelm | ..... | 451/240 |
| 1,002,124 A | 8/1911 | Borensen | ..... | 451/384 |
| 1,184,496 A | 5/1916 | Stenvall | ..... | 123/80 C |
| 1,721,161 A | 7/1929 | Maynard | ..... | 451/384 |
| 2,209,605 A | 7/1940 | Maynard | ..... | 451/240 |
| 2,441,472 A | 5/1948 | D'Avacourt | ..... | 51/216 |
| 2,573,668 A | 10/1951 | Long | ..... | 51/277 |

(List continued on next page.)

*Primary Examiner*—Randy W. Gibson
(74) *Attorney, Agent, or Firm*—Liniak, Berenato & White, LLC

(57) ABSTRACT

A control system is provided for a pivotally actuated tracer which traces an object (e.g., a frame mount of an eyeglass frame, a lens, or a lens pattern) while the object is held in a more-vertical-than-horizontal orientation. The control system comprises a trace control element and a gravity compensation element. The trace control element applies control signals to the pivotally actuated tracer. In response, the object engager of the tracer is pivotally actuated against and along the object to be traced with a biasing force toward the object. The gravity compensation element is adapted to compensate for the effects of gravity on the object engager by causing a varying pivoting force to be exerted on the object engager. The pivoting force varies depending on the rotational orientation of the object engager to keep the biasing force substantially constant along the object. Also provided is a data acquisition system for the tracer. The data acquisition system comprises a position monitoring element and a conversion element. The position monitoring element detects pivot information and extension information during a tracing operation. The pivot information and extension information define polar coordinate information when combined with rotational information indicative of the rotational orientation of the object engager. The conversion element provides cylindrical coordinate information based on the polar coordinate information. Methods which can be carried out by the system(s) or otherwise also are provided, for achieving similar results.

19 Claims, 3 Drawing Sheets

Microfiche Appendix Included
(2 Microfiche, 192 Pages)

U.S. PATENT DOCUMENTS

| | | | | | |
|---|---|---|---|---|---|
| 2,748,541 | A | | 6/1956 | Connell | 51/101 |
| 3,410,031 | A | | 11/1968 | Soong | 51/237 |
| 3,631,637 | A | | 1/1972 | Tagnan | 51/237 |
| 3,771,265 | A | | 11/1973 | Bright | 51/101 |
| 4,051,601 | A | | 10/1977 | Godot | 33/174 |
| 4,217,736 | A | | 8/1980 | Akaba et al. | 51/284 |
| 4,561,213 | A | | 12/1985 | Tusinski et al. | 51/105 |
| 4,562,671 | A | | 1/1986 | Bouillon et al. | 51/216 |
| 4,612,732 | A | * | 9/1986 | Delattre et al. | 451/5 |
| 4,653,234 | A | | 3/1987 | Lombard | 51/216 |
| 4,653,881 | A | | 3/1987 | Jancour | 351/204 |
| 4,724,617 | A | | 2/1988 | Logan et al. | 33/28 |
| 4,912,880 | A | | 4/1990 | Haddock et al. | 51/101 |
| 4,941,291 | A | | 7/1990 | Brueck | 51/105 |
| 4,945,684 | A | | 8/1990 | Wada et al. | 51/165.77 |
| 4,951,421 | A | | 8/1990 | Brueck | 51/105 |
| 4,991,305 | A | | 2/1991 | Saigo et al. | 33/507 |
| 4,993,195 | A | | 2/1991 | Gray | 51/281 |
| 5,053,971 | A | | 10/1991 | Wood et al. | 364/474.06 |
| 5,097,600 | A | | 3/1992 | Brule et al. | 33/28 |
| 5,121,548 | A | | 6/1992 | Daboudet et al. | 33/507 |
| 5,121,550 | A | | 6/1992 | Wood et al. | 33/551 |
| 5,137,263 | A | | 8/1992 | Savoie et al. | 269/266 |
| 5,139,373 | A | | 8/1992 | Logan et al. | 409/80 |
| 5,158,422 | A | | 10/1992 | Wagner | 409/84 |
| 5,195,246 | A | | 3/1993 | Chansavoir | 33/28 |
| 5,210,695 | A | | 5/1993 | Wood | 364/474.06 |
| 5,228,242 | A | | 7/1993 | Matsuyama | 51/165.74 |
| 5,283,980 | A | | 2/1994 | Lohrenz | 51/165.72 |
| 5,307,150 | A | | 4/1994 | Lecerf et al. | 356/376 |
| 5,341,604 | A | | 8/1994 | Wood | 51/165.71 |
| 5,431,595 | A | | 7/1995 | Underwood | 451/237 |
| 5,501,017 | A | | 3/1996 | Suzuki | 33/200 |
| 5,515,612 | A | | 5/1996 | Igarashi et al. | 33/200 |
| 5,554,067 | A | | 9/1996 | Lecerf et al. | 457/384 |
| 5,567,198 | A | | 10/1996 | Cook | 451/384 |
| 5,594,992 | A | | 1/1997 | Suzuki et al. | 33/200 |
| 5,611,252 | A | | 3/1997 | Hattori et al. | 82/165 |
| 5,615,486 | A | | 4/1997 | Igarashi et al. | 33/200 |
| 5,649,856 | A | | 7/1997 | Cook | 451/460 |
| 5,695,393 | A | | 12/1997 | Granziera | 451/390 |
| 5,746,436 | A | | 5/1998 | Kulan et al. | 279/4.04 |
| 5,763,075 | A | | 6/1998 | Benjamin et al. | 428/349 |
| 5,775,973 | A | | 7/1998 | Watanabe | 451/5 |
| 5,785,580 | A | | 7/1998 | Cook | 451/42 |
| 5,802,731 | A | | 9/1998 | Guillermin et al. | 33/502 |
| 5,845,408 | A | | 12/1998 | Chansavoir et al. | 33/200 |
| 6,249,991 | B1 | * | 6/2001 | Rarick et al. | 33/200 |
| 6,270,392 | B1 | * | 8/2001 | Hayashi | 451/5 |

* cited by examiner

CONTROL SYSTEM FOR EYEGLASS TRACER

This application is a continuation of 09/271,271 filed Mar. 17, 1999 now U.S. Pat. No. 6,249,991.

A portion of the disclosure of this patent application contains material which is subject to copyright protection. The copyright owner has no objection to the reproduction by anyone of the patent document as it appears in the Patent and Trademark Office files or records, but otherwise reserves all copyrights whatsoever. Software for carrying out some of the methods and systems described herein has been filed with the United States Patent and Trademark Office herewith in the form of a microfiche appendix including numerous frames, one of which being a title frame. This software may be included as part of a chip or disc according to certain embodiments of this invention. The microfiche appendix is entitled CONTROL SYSTEM FOR EYEGLASS TRACER and includes two (2) microfiche and one hundred ninety two (192) total frames.

BACKGROUND OF THE INVENTION

The present invention relates to a control and/or data acquisition system for a pivotally actuated tracer, which system is adapted to provide compensation for the effects of gravity on the tracer and/or convert acquired data from a polar format to a Cartesian format.

Generally, tracers are used to acquire information about the shape of an object being traced (hereinafter "the object"). Such tracers typically have means (i.e., an object engager) for engaging the object, as well as means for moving the object engager along the object while the position of the object engager is monitored. The resulting position information then is used to determine the shape of the object. Typically, the movement of the object engager is performed using linear actuators/position detectors. One linear actuator/position detector provides movement/position detection with respect to an X-axis, while another provides movement/position detection with respect to an orthogonal Y-axis. Such arrangements, while generally effective, leave room for improvement.

A tracer therefore has been developed by the Assignee hereof, which tracer realizes certain benefits by using at least one pivotally actuated object engager instead of a linearly actuated one. The exemplary tracer having a pivotally actuated object engager is described in a contemporaneously filed patent application entitled TRACER, CLAMP, AND OBJECT ENGAGER FOR HOLDING AND TRACING A LENS MOUNT OF AN EYEGLASS FRAME, A LENS, AND/OR A LENS PATTERN, TO RELIABLY DETECT A SHAPE THEREOF EVEN WHEN THE SHAPE INCLUDES WRAP-AROUND, filed on Mar. 16, 1999 by Andrews et al. on behalf of the Assignee hereof. The contents of that patent application are incorporated herein by reference.

Tracers having pivotally actuated object engagers achieve significant advantages over those which provide linear actuation of the object engager. Such pivot-based tracers, for example, can be provided using a relatively compact actuation mechanism. They also are more compatible with rotary encoders which provide positional information based on an actuating element's rotation. Rotary encoders typically are less expensive than linear encoders. The pivot-based tracer arrangements therefore achieve significant savings in manufacturing costs, as well as an advantageously compact structure.

The pivot-based tracer described in the aforementioned patent application is particularly well-suited for tracing lens mounts in an eyeglass frame. It also is well-suited for tracing of lenses or lens patterns.

Lens mounts, lenses, and lens patterns typically are traced in order to generate trace data, which data then is supplied to an edging apparatus. The edging apparatus then processes the edge of a lens blank to create an edge profile which matches the trace data. The resulting lens fits within the traced lens mount or matches the shape of the traced lens or lens pattern.

During a tracing operation, the object engager of the exemplary pivot-based tracer is actuated along the object to be traced. The object engager is associated with a pivot arm and has a predetermined object engaging feature (e.g., a stylus which engages an eyeglass frame, a groove for receiving the beveled edge of a lens, or a shoulder which engages an edge of a lens pattern). The object engaging feature is rotated along the inner circumference of the frame mount or around the outer circumference of the lens or lens pattern. During such rotations, the object engager is pivoted toward or away from the rotational axis and is extended or retracted along the pivot arm to keep the same object engaging feature in contact with the object being traced.

At each of a plurality of rotational positions, the amount of pivoting and the amount of translation (extension or retraction) are recorded. When the rotational position is combined with the amount of pivoting and the amount of translation, a three-dimensional vector is provided for each rotational position. The three-dimensional vector is represented by polar coordinates (Theta, Phi, Beta), wherein Theta represents the rotational orientation about an axis of rotation, Phi represents the pivot angle of the pivot arm, and Beta represents how far the object engager has been extended.

Most edging apparatuses, however, are configured to accept data in cylindrical format, not polar format. There is consequently a need in the art for a system capable of converting trace information in polar format into trace information in cylindrical format, the latter being more compatible with existing edging apparatuses.

Another feature of the exemplary pivot-based tracer described in the aforementioned patent application is a clamp which holds the object (i.e., the eyeglass frame, the lens, or the lens pattern) in a vertical or near-vertical orientation during the disclosed tracing process. As disclosed in that application, the vertical or near-vertical orientation allows eyeglass frames which have a wrap-around feature (e.g., a curved temple portion which wraps around the face of the wearer) to be traced without gravity causing the object engager to "fall out" from the groove which holds the lens in the eyeglass frame.

Yet another benefit of the vertical or near-vertical orientation is that it facilitates viewing of the eyeglass frame's engagement with the clamp from the operator's natural line of sight. It also facilitates use of a more natural and comfortable arm movement when placing the object being traced in the clamp.

The vertical or near-vertical orientation, however, causes the magnitude of the force exerted by the object engager against the object being traced to vary as a function of the rotational orientation of the object engager. When the object engager traces the lower part of a lens mount in the eyeglass frame, for example, gravitational forces add to the biasing force toward the lens mount. By contrast, when the top of the lens mount is being traced, gravity counteracts the biasing force toward the lens mount.

The opposite is true during tracing of the lens or lens pattern. When a lens or lens pattern is traced, the tracing is performed around the external circumference, as opposed to the internal circumference. Gravity therefore tends to pull the object engager away from the lens or lens pattern when the bottom, not the top, of the lens or lens pattern is being traced. Likewise, when the top of the lens or lens pattern is being traced, gravity urges the object engager toward the object being traced.

At the nine-o'clock and three-o'clock orientations (the 180 degree and 0 degree tracing positions), the gravitational force on the object engager is orthogonal to the biasing force and therefore does not contribute to or counteract the biasing force.

During the tracing operation, it is desirable to apply a more constant force against the lens mount, lens, or lens pattern. Variations in the force applied against the lens mount, lens or lens pattern can cause inaccuracies in the trace data. In extreme cases, the variations which contribute to the biasing force might be strong enough to slightly overcome the clamping force and cause movement of the object being traced. Likewise, the variations which counteract the biasing force may be enough to cause the object engager to become disengaged from the lens mount, lens, or lens pattern.

There is consequently a need in the art for a control and/or data acquisition system for a pivotally actuated tracer, which system is capable of providing compensation for the effects of gravity on the tracer when the tracer holds objects to be traced in a vertical or near-vertical orientation.

SUMMARY OF THE INVENTION

A primary object of the present invention is to overcome at least one of the foregoing problems and/or satisfy at least one of the aforementioned needs in the art.

Another object of the present invention is to provide a control system for a pivotally actuated tracer, which control system is adapted to provide compensation for the effects of gravity on the tracer.

Still another object of the present invention is to provide a data acquisition system for a pivotally actuated tracer, which data acquisition system is adapted to convert acquired data from the tracer in a polar format into acquired data in a cylindrical format.

Yet another object of the present invention is to provide an integrated control and data acquisition system for a pivotally actuated tracer, which system is adapted to provide compensation for the effects of gravity on the tracer and also is adapted to convert acquired data from the tracer in a polar format-into acquired data in a cylindrical format.

To achieve these and other objects, the present invention provides a control system for a pivotally actuated tracer which traces an object while the object is held in a more-vertical-than-horizontal orientation. The control system comprises a trace control element and a gravity compensation element. The trace control element is adapted to apply control signals to the pivotally actuated tracer. The control signals cause an object engager of the tracer to be pivotally actuated against and along the object to be traced with a biasing force toward the object, while the object engager is rotated along the object. The gravity compensation element is adapted to compensate for the effects of gravity on the object engager by causing the trace control element to apply the control signals in such a way that the tracer exerts a pivoting force on the object engager. The pivoting force varies depending on the rotational orientation of the object engager to keep the biasing force substantially constant along the object. The biasing force is a sum of the-pivoting force and a component of gravitational force on the object engager directed toward the object.

The present invention also provides a data acquisition system for a pivotally actuated tracer. The data acquisition system comprises a position monitoring element and a conversion element. The position monitoring element is adapted to detect, while a pivotally mounted object engager of the tracer is rotated, pivot information indicative of how far the object engager has been pivoted and extension information indicative of how far the object engager has been extended from a pivot axis of the tracer. The pivot information and extension information define polar coordinate information when combined with rotational information indicative of the rotational orientation of the object engager at instances when the pivot information and the extension information are detected. The conversion element is adapted to convert at least one aspect of the polar coordinate information into cylindrical coordinate information.

Also provided by the present invention is a control and data acquisition system for a pivotally actuated tracer which traces an object while the object is held in a more-vertical-than-horizontal orientation. The control system comprises a trace control element, gravity compensation element, position monitoring element, and a conversion element. The trace control element is adapted to apply control signals to the pivotally actuated tracer. The control signals cause an object engager of the tracer to be pivotally actuated against and along the object to be traced with a biasing force toward the object, while the object engager is rotated along the object. The gravity compensation element is adapted to compensate for the effects of gravity on the object engager by causing the trace control element to apply the control signals in such a way that the tracer exerts a pivoting force on the object engager which varies depending on the rotational orientation of the object engager to keep the biasing force substantially constant along the object. The biasing force is a sum of the pivoting force and a component of gravitational force on the object engager directed toward the object. The position monitoring element is adapted to detect, while the object engager is rotated, pivot information indicative of how far the object engager has been pivoted and extension information indicative of how far the object engager has been extended from a pivot axis of the tracer. The pivot information and extension information define polar coordinate information when combined with rotational information indicative of the rotational orientation of the object engager at instances when the pivot information and the extension information are detected. The conversion element is adapted to convert at least one aspect of the polar coordinate information into cylindrical coordinate information.

The present invention also provides a method of tracing an object while the object is held in a more-vertical-than-horizontal orientation. The method comprises the steps of: holding the object in a more-vertical-than-horizontal orientation; pivotally actuating an object engager against and along the object with a biasing force toward the object, while the object engager is rotated along the object; and compensating for the effects of gravity on the object engager by exerting a pivoting force on the object engager which varies depending on the rotational orientation of the object engager to keep the biasing force substantially constant along the object. The biasing force is a sum of the pivoting force and a component of gravitational force on the object engager directed toward the object.

The present invention also provides a method of acquiring data using a pivotally actuated tracer. The method comprises the steps of: engaging a pivotally mounted object engager of the tracer against an object to be traced; rotating the pivotally mounted object engager so that the object engager keeps an object engaging feature thereof engaged against the object; and detecting, while the pivotally mounted object engager of the tracer is rotated, pivot information indicative of how far the object engager has been pivoted and extension information indicative of how far the object engager has been extended from a pivot axis of the tracer. The pivot information and extension information define polar coordinate information when combined with rotational information indicative of the rotational orientation of the object engager at instances when the pivot information and the extension information are detected. The method further comprises the step of converting at least one aspect of the polar coordinate information into cylindrical coordinate information.

The above and other objects and advantages will become more readily apparent when reference is made to the following description taken in conjunction with the accompanying drawings.

DESCRIPTION OF PREFERRED EMBODIMENTS

According to a preferred embodiment of the present invention, a control and/or data acquisition system is provided for a pivotally actuated tracer. The control and/or data acquisition system is adapted to provide compensation for the effects of gravity on the tracer and/or is adapted to convert acquired data from a polar format to a cylindrical format.

Preferably, the system of the present invention is provided in an integrated form which provides both the control and data acquisition functions. The invention, however, is not limited in this regard. The present invention may be practiced, for example, by providing a control system which provides compensation for the effects of gravity on the tracer, but does not convert the acquired data from a polar format to a cylindrical format. Likewise, the present invention may be practiced by providing a data acquisition system which converts acquired data from a polar format to a cylindrical format, without compensating for the effects of gravity on the tracer.

Preferably, the control and data acquisition system of the present invention is provided in software form. An example of the software form of the system is included in the control program which appears in the concurrently filed microfiche appendix. The software is stored in a memory device and is executed by a suitable processing device. The memory device may be a part of; or separate from, the processing device.

An exemplary combination of memory and processing devices is disclosed in the aforementioned patent application, and need not be described in any further detail in this application. Those of ordinary skill in the art will readily appreciate that other processing and memory devices can be used. The control and data acquisition system also may be practiced using firmware and hardware components which are substituted for some or all of the software contained in the exemplary control program.

According to the preferred embodiment, the suitably programmed memory and processing devices are located on a printed circuit board of the tracer. The processing device selectively activates driver circuits on the printed circuit board which, in turn, cause the tracer's individual components to operate in the manner dictated by the control program and any other user inputs which may be provided by a suitable user interface device.

Figure 1:
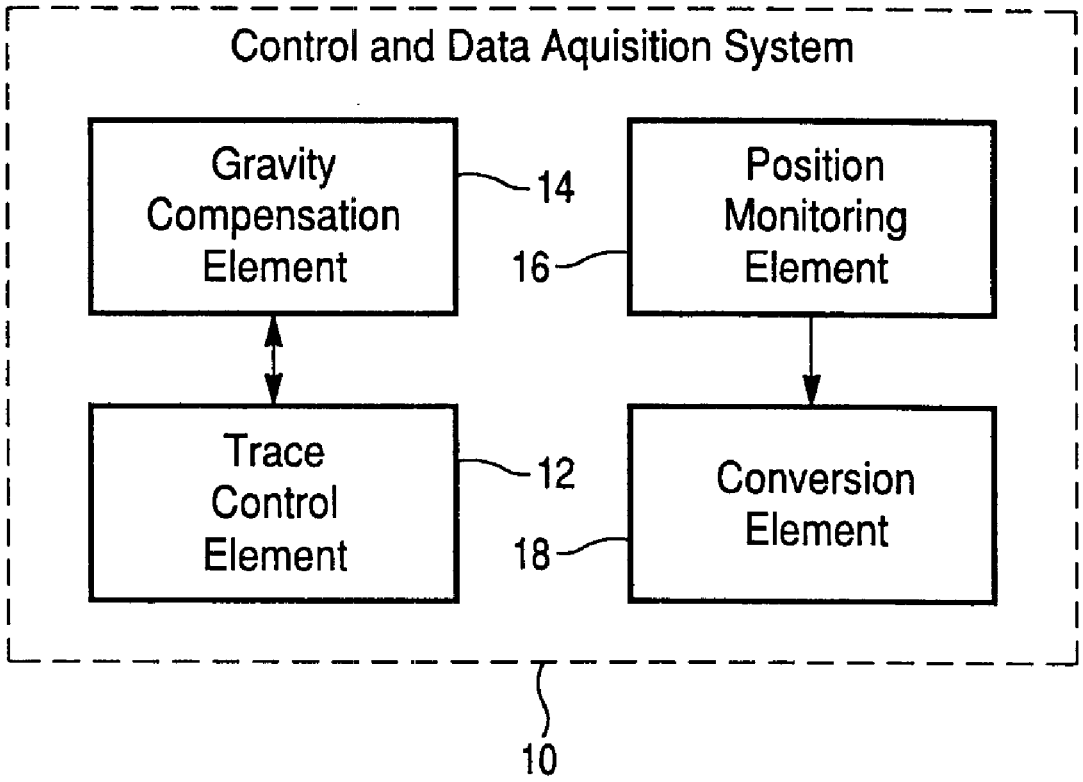
FIG. 1 is a block diagram of a control and data acquisition system according to a preferred implementation of the present invention.

As illustrated in FIG. 1, the control program in the microfiche appendix, when implemented by the processing unit of the tracer, provides a control and data acquisition system 10. The control program thus provides both gravity compensation and conversion of the acquired data from a polar format to a cylindrical format. It causes the pivotally actuated tracer to trace an object (e.g., a lens mount of an eyeglass frame, a lens, or a lens pattern) while the object is held in a more-vertical-than-horizontal orientation (e.g., about ten degrees from vertical).

The control program includes a trace control element 12 and a gravity compensation element 14. The trace control element 12 is adapted to apply control signals to the pivotally actuated tracer, which control signals cause the object engager of the tracer to be pivotally actuated against and along the object to be traced with a biasing force toward the object, while the object engager is rotated along the object.

The gravity compensation element 14 is adapted to compensate for the effects of gravity on the object engager by causing the trace control element 12 to apply the control signals in such a way that the tracer exerts a pivoting force on the object engager which varies depending on the rotational orientation of the object engager to keep the biasing force substantially constant along the object. The biasing force is the sum of 1) the pivoting force and 2) the component of gravitational force on the object engager which is directed toward the object.

The control program's operation varies depending on whether the object being traced is a lens or lens pattern on the one hand, or the lens mounts of an eyeglass frame on the other hand. When the object being traced is a lens or lens pattern, the tracer control element 12 applies the control signals so that the biasing force is applied radially inwardly with respect to a rotational axis about which the object engager rotates. The object engager thereby presses against the edge of the lens or lens pattern while it is rotated around that edge. Since gravity counteracts the biasing force as the bottom part of the lens or lens pattern is being traced and contributes to the biasing force as the top part is traced, the gravity compensation element 14 cause the trace control element 12 to apply the control signals in such a way that the tracer exerts a progressively smaller pivoting force the closer the object engager comes to an uppermost rotational position and a progressively larger pivoting force the closer the object engager comes to a lowermost rotational position.

When the object to be traced is a lens mount of an eyeglass frame, by contrast, the tracer control element 12 applies the control signals so that the biasing force is applied in a radially outward direction. The object engager thereby engages the inner circumference of the lens mount as it is rotated along this inner circumference. Since gravity counteracts the biasing force when the top of the lens mount is being traced and contributes to the biasing force at the bottom of the lens mount, the gravity compensation element 14 causes the trace control element 12 to apply the control signals in such a way that the tracer exerts a progressively larger pivoting force the closer the object engager comes to an uppermost rotational position and a progressively smaller pivoting force the closer the object engager comes to a lowermost rotational position.

According to the exemplary control program, the pivoting force varies substantially as a predetermined function of rotational orientation of the object engager. The predetermined function is:

for rotational orientations from zero to 99 grads:

rbias@n=rbias@zero+abs@rbias@100−rbias@zero)*sin(n);

for rotational orientations from 100 to 199 grads:

rbias@n=rbias@200+abs@rbias@100−rbias@200)*sin(n);

for rotational orientations from 200 to 299 grads:

rbias@n=rbias@200+abs@rbias@300−rbias@200)*sin(n); and for rotational orientations from 300 to 399 grads:

rbias@n=rbias@zero+abs@rbias@300−rbias@zero)*sin(n), wherein the 100 and 300 grad orientations are defined as the rotational orientations in which the object engager is rotated to its highest position and its lowest position, respectively. In the predetermined function, the variable "n" represents the rotational orientation in angular units, "rbias@n" represents the pivoting force at the rotational orientation "n", "abs" represents an absolute value operation, "rbias@zero" represents a value of pivoting force which is empirically determined to provide favorable resistance to object disengagement at the zero grad orientation, "rbias@100" represents a value of pivoting force which is emperically determined to provide favorable resistance to object disengagement at the 100 grad orientation, "rbias@200" represents a value of pivoting force which is emperically determined to provide favorable resistance to object disengagement at the 200 grad orientation, and "rbias@300" represents a value of pivoting force which is emperically determined to provide favorable resistance to object disengagement at the 300 grad orientation.

While the value of rbias@n can be calculated for each rotational orientation by providing the processing unit with appropriate math processing capabilities, the exemplary control program avoids the need for such capabilities by referencing a look-up table in memory at different rotational orientations "n". The look-up table contains a value of rbias@n corresponding to each rotational orientation. Such values are stored as constant values in memory after being calculated using the foregoing function. The function, in turn, is based on the emperically determined values for rbias@zero, rbias@100, rbias@200, and rbias@300. Thus, in the exemplary control program, only the values for rbias@zero, rbias@100, rbias@200, and rbias@300 are emperically determined. The rest are calculated and stored in memory. The value of rbias@n in the look-up table for each rotational orientation "n" then is used by the processing unit to determine what the magnitude of the pivoting force will be at that orientation.

While the exact function described above can be applied at each increment of the rotational orientation, the exemplary control program instead approximates the function by providing a different value of rbias@n only after ten increments of the rotational orientation, each increment being a one grad increment. In this way, the exemplary control program takes advantage of the fact that the effects of gravity on the object engager will not change significantly from one rotational increment (of one grad) to the next. The differences in the effects of gravity provided by rotation of the object engager generally do not become significant until the object engager is rotated about 8 to 12 grads, more specifically, about 10 grads. The gravity compensation element 14 thus approximates the function of rotational orientation by treating each of a plurality of ten-grad intervals of rotational orientation with a single respective value of rbias@n. The single respective value is representative of the actual rbias@n values in that interval and is selectable by the gravity compensation element by reference to the look-up table. Since there are forty different intervals in the 400 grad revolution, the look-up table includes forty of the respective values of rbias@n. The control program therefore adjusts the pivoting force after every ten increments of the rotational orientation using the appropriate one of the forty rbias@n values.

The same type of gravity compensation techniques can be used for situations where a lens or lens pattern is being traced, except that the pivoting force is applied radially inwardly and the function described above is modified so that the pivoting force correspondingly increases toward the bottom of the trace and decreases toward the top of the trace.

The tracer, when operating according to the exemplary control program, determines whether the object being traced is a lens, lens mount, or lens pattern based on object type information which is entered by an operator of the tracer. This object type information can be entered by the operator via a keypad on the tracer. The present invention, however, is not limited in this regard. The object type, for example, can be detected automatically by a suitably equipped tracer, as described in the contemporaneously filed application. Regardless of how the object type information is provided, the control program implements the corresponding gravity compensation technique to keep the biasing force substantially constant.

The exemplary control program also provides a data acquisition system for the pivotally actuated tracer. The data acquisition system includes a position monitoring element 16 and a conversion element 18. The position monitoring element 16 is adapted to detect, while the pivotally mounted object engager of the tracer is rotated, pivot information indicative of how far the object engager has been pivoted and extension information indicative of how far the object engager has been extended from a pivot axis of the tracer. The pivot information and extension information define polar coordinate information when combined with rotational information indicative of the rotational orientation of the object engager at instances when the pivot information and extension information are detected. The conversion element 18 is adapted to convert at least one aspect of the polar coordinate information into cylindrical coordinate information.

The aspects of the polar coordinate information which are converted into cylindrical coordinate information by the exemplary control program are the pivot information and the extension information. The conversion element 18 converts the pivot information and the extension information into:

1) a first cylindrical parameter R indicative of a linear displacement of an object engaging feature of the object engager in a radial direction from a rotational axis about which the object engager rotates, and
2) a second cylindrical parameter Z indicative of the linear displacement of the object engaging feature in an axial direction which is parallel to the rotational axis.

Figure 2:
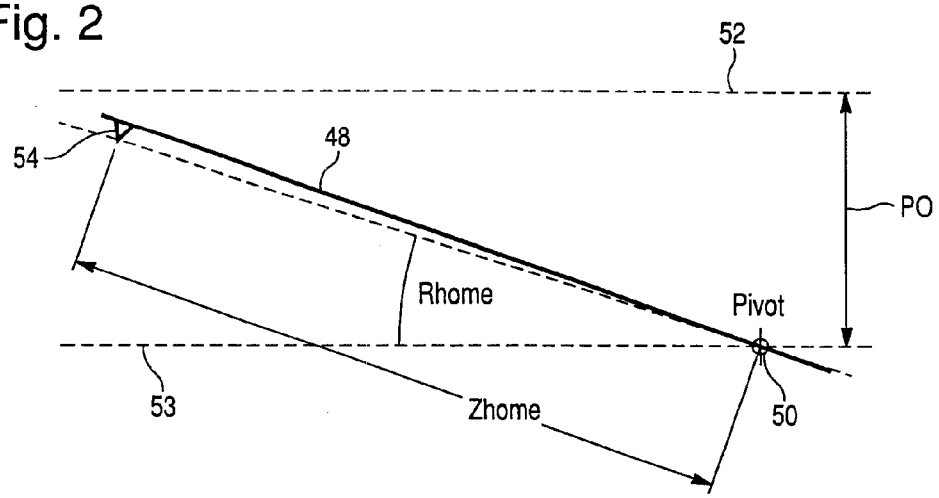
FIG. 2 is a schematic diagram showing a "home" position of an object engager according to a preferred implementation of the present invention.

As illustrated in FIG. 2, the particular tracer to which the exemplary control program is directed has a object engager 48 with a pivot axis 50. The pivot axis 50 is displaced radially from the rotational axis 52 by a pivot offset PO and is located on a pivot reference line 53 which is parallel to the rotational axis 52.

When a tracing operation is to begin, the object engager 48 is initially brought into a "home" position. If the object to be traced is a lens mount, the "home" position may place the object engaging feature 54 at the rotational axis 52. It is understood, however, that other positions close to the rotational axis 52 will suffice, so long as the radial distance from the rotational axis 52 is small enough for the object engaging feature 54 to be located inside the lens mount. The "home" position also may involve some extension of the object engager 48.

An exemplary "home" position is illustrated in FIG. 2. In FIG. 2, Rhome represents the angle between the object engager 48 and the pivot reference line 53. Zhome represents how far the object engaging feature 54 is located from the pivot axis 50. From the "home" position, the control program causes the object engager 48 to be pivoted toward the lens mount being traced.

Figure 3:
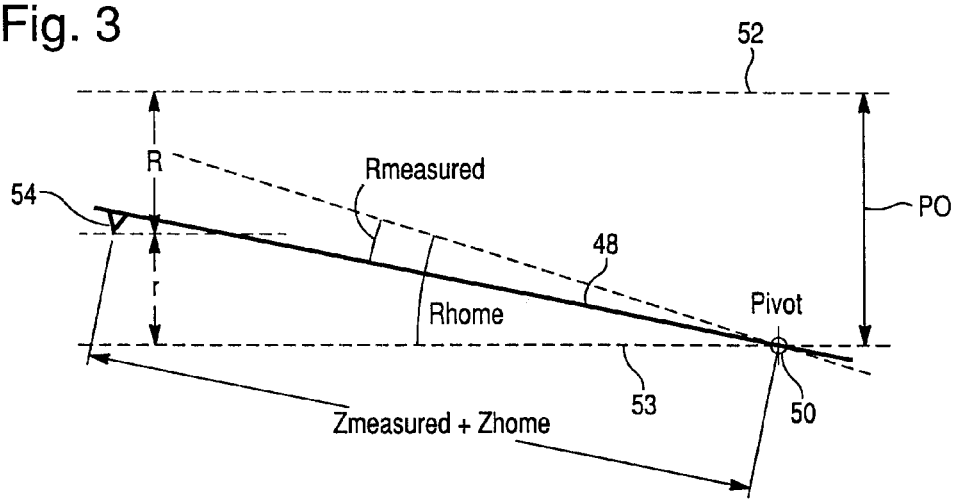
FIGS. 3 and 4 are schematic diagrams showing the same object engager after it has been pivoted and extended into engagement with a lens mount of an eyeglass frame.
Figure 4:
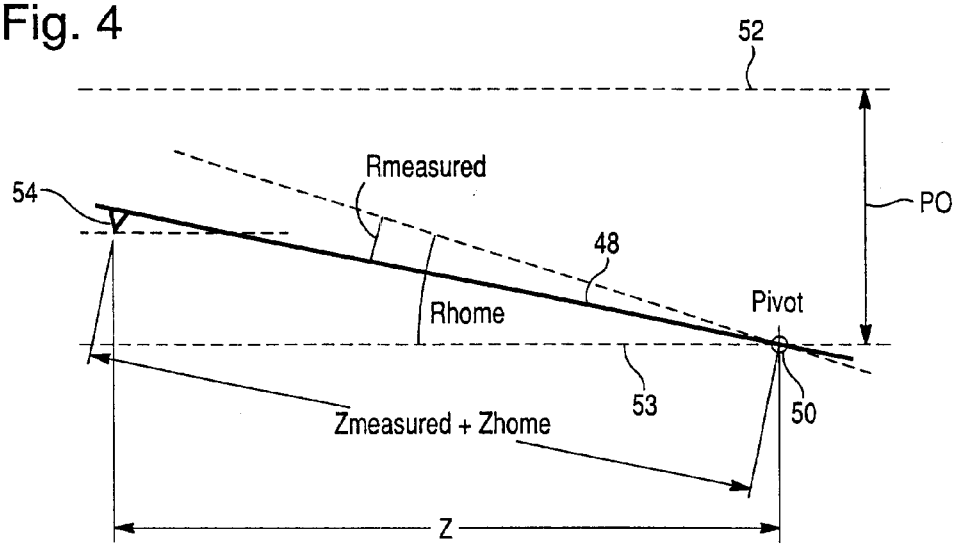

As illustrated in FIGS. 3 and 4, when the lens mount is reached by the object engaging feature 54, an angle Rmeasure represents the angle through which the object engager 48 was pivoted in reaching the lens mount. Rmeasure can be detected by the tracer's processing unit because it is corresponds to how much rotation of a pivot motor was required in order to reach the lens mount. In addition, the tracer's processing unit is able to determine how far the object engaging feature 54 is located from the pivot axis 50 because that distance (represented in FIG. 4 by Zmeasured+Zhome) corresponds to how much an extension motor was rotated in reaching the lens mount.

The control program thus is able to direct the processing unit to determine the first cylindrical parameter R using the equation:

$$R=PO-[(\text{Zmeasured}+\text{Zhome})*\sin(\text{Rhome}-\text{Rmeasured})]$$

The control program also is able to direct the processing unit to determine the second cylindrical parameter Z using the equation:

$$Z=[(\text{Zmeasured}+\text{Zhome})*\cos(\text{Rhome}-\text{Rmeasured})]$$

Notably, the second cylindrical parameter Z is indicative of the linear displacement of the object engaging feature 54 in an axial direction which is parallel to, not coincident with, the rotational axis.

In situations where the control program is applied to a tracer which has its pivot axis located on the rotational axis, the linear displacement represented by the second cylindrical parameter Z would instead be defined along the rotational axis.

Since the object engaging feature which is appropriate for the particular tracing operation depends on the object being traced, the control program preferably operates in a manner responsive to object type information indicative of whether the object being traced is a lens mount of an eyeglass frame, a lens or a lens pattern. The object engager of the exemplary tracer described in the contemporaneously filed patent application includes, for example, a stylus adapted to engage a lens mount, a groove adapted to receive a beveled edge of a lens, and a shoulder adapted to engage an edge of a lens pattern. The stylus is located on one surface of the object engager, while the groove and shoulder are located on an opposite surface. The reason for this is that the inside circumference of the lens frame is what is traced by the stylus, whereas each of the lenses and lens patterns has an outside circumference which is to be traced.

The position monitoring element of the control program is adapted to respond to the object type information by registering the pivot information as a displacement from a reference pivot position (e.g., Rhome when tracing a lens mount) which is selected based on the object type information and by registering the extension information as a displacement from a reference extension position (e.g., Zhome when tracing a lens mount) which also is selected based on the object type information. The reference pivot position for lenses may be the same as the reference pivot position for lens patterns, but generally such reference pivot positions will involve a much smaller pivot angle than Rhome (i.e., the reference pivot position for lens mounts). The smaller pivot angle is used for the reference pivot positions of the lenses and lens patterns because those objects have their outer circumferences traced, whereas the lens mounts have their inner circumference traced.

The conversion element 18 is adapted to perform the desired conversion in substantially the same way for lenses and lens patterns, as it does for lens mounts. The slight differences in conversion technique relate to the differences in positioning of the respective object engaging features on the object engager, and the fact that the tracing of the lenses and lens patterns is performed around the exterior circumference, as opposed to the inner circumference.

The control program, as indicated above, causes the object engager to rotate about the rotational axis 52, while applying an appropriate biasing force. The rotation is provided in increments of preferably one grad per increment. At each increment of the rotational orientation, the control program's position monitoring element 16 causes the pivot information and the extension information to be sampled. From each such sample, the control program causes the first cylindrical parameter R and the second cylindrical parameter Z to be calculated in substantially the same way as the initial ones were calculated.

The size of each increment, of course, is not limited to one grad. To the contrary, the number of grads per increment will depend on the desired resolution of the acquired trace data.

The cylindrical parameters R and Z are more acceptable to some conventional edging devices than the polar format. The conversion element of the control program therefore enhances the compatibility of the pivotally actuated tracer disclosed in the contemporaneously filed application.

Additional compatibility is provided by providing the control program with the ability to rearrange the presentation or order of the acquired data to suit a particular edging device. Some edging devices expect to receive the trace data in a particular order. One often used order depends on whether the right eye information is being provided or left eye information. The right eye information starts at the bridge of the eyeglass frames and is followed by the upper part of the lens mount, then the temple area, followed by the bottom of the lens mount. The left eye information starts at the temple area, followed by the upper part of the lens mount, then the bridge of the eyeglass frames, followed by the lower part of the lens mount. The control program, however, causes the tracing operation for both the left and right side openings in the eyeglass frame to begin at the top of each frame mount. Because of the difference in the way the control program causes traced data to be acquired and the way some edging device expect to receive that data, the control program causes the data to be stored in a different order in memory or alternatively causes the data to be communicated to the edging device in an order different from how it is stored in memory. The edging device thus receives the trace data in the order which it expects. The control program therefore is not limited to delivery of trace data in the order in which it is acquired.

Figure 5:
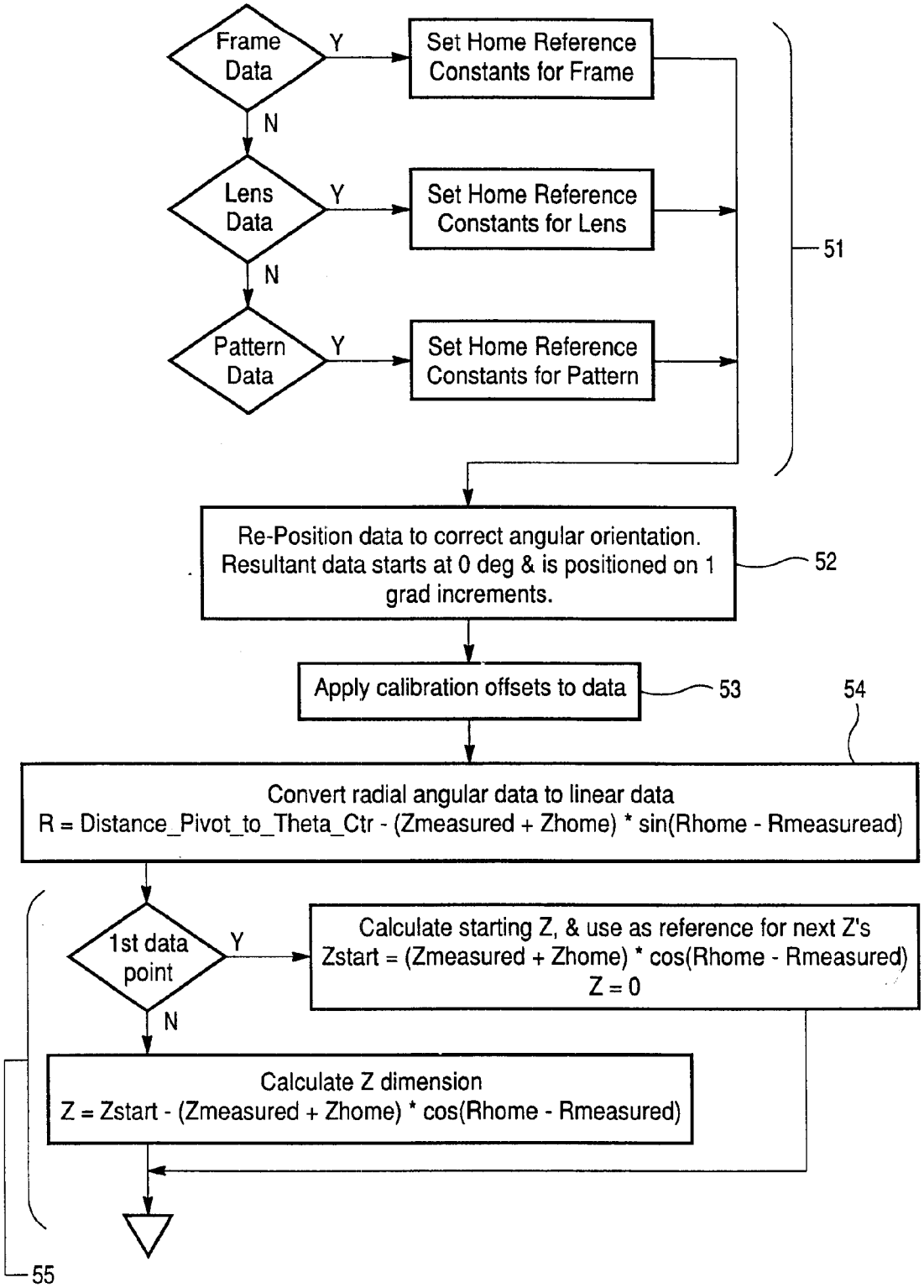
FIG. 5 is a flow chart of a preferred sequence of operations carried out by the control program according to a preferred implementation of the present invention

The exemplary control program also provides calibration offsets to the acquired data. A preferred sequence which is implemented by the control program when providing the data conversion is illustrated in FIG. 5.

Initially, the home reference constants are set in a manner dependent upon the object being traced (Step S1). The data then is "repositioned" to the correct angular orientation (Step S2). The calibration offsets then are applied to the data (Step S3). Next, the first cylindrical parameter R is calculated (Step S4), followed by calculation of the second cylindrical parameter Z or setting of the first Z depending on whether the current Z value is the first in the tracing cycle (Step S5).

The present invention also provides a method of tracing an object while the object is held in a more-vertical-than-horizontal orientation. The method can be implemented by the tracer using the exemplary control program. The method comprises the steps of holding the object (e.g., lens mounts of an eyeglass frame, a lens, or lens pattern) in a more-vertical-than-horizontal orientation; pivotally actuating the object engager against and along the object with a biasing force toward the object, while the object engager is rotated along the object; and compensating for the effects of gravity on the object engager by exerting a pivoting force on the object engager which varies depending on the rotational orientation of the object engager to keep the biasing force substantially constant along the object. The biasing force is a sum of the pivoting force and a component of gravitational force on the object engager directed toward the object.

Preferably, the method also includes the step of determining whether the object being traced is a lens, lens pattern, or lens mount. When the object is a lens mount of an eyeglass frame, by contrast, the biasing force is applied in a radially outward direction. The pivoting force is progressively larger the closer the object engager comes to an uppermost rotational position and progressively smaller the closer the object engager comes to a lowermost rotational position.

When the object is a lens or a lens pattern, the biasing force is applied radially inwardly with respect to a rotational axis about which the object engager rotates. The pivoting force is progressively smaller the closer the object engager comes to an uppermost rotational position and progressively larger the closer the object engager comes to a lowermost rotational position. Preferably, the method is practiced by applying the pivoting force so that it substantially obeys the aforementioned equations for rbias@n. This can be achieved using a look-up table and/or techniques for approximating the equations, as described above.

The present invention also provides a method of acquiring data using the pivotally actuated tracer. The method comprises the steps of: engaging the pivotally mounted object engager of the tracer against an object to be traced; rotating the pivotally mounted object engager so that the object engager keeps an object engaging feature thereof (e.g., a stylus, groove, or shoulder) engaged against the object; and detecting, while the pivotally mounted object engager of the tracer is rotated, pivot information indicative of how far the object engager has been pivoted and extension information indicative of how far the object engager has been extended from a pivot axis of the tracer. The pivot information and extension information define polar coordinate information when combined with rotational information indicative of the rotational orientation of the object engager at instances when the pivot information and the extension information are detected. The method further includes the step of converting at least one aspect of polar coordinate information into cylindrical coordinate information.

While the methods provided by the present invention preferably are executed in a computer-implemented manner by the aforementioned control program, it is understood that the method can be practiced using alternative means and tracer configurations.

While this invention has been described as having a preferred design, it is understood that the invention is not limited to the illustrated and described features. To the contrary, the invention is capable of further modifications, usages, and/or adaptations following the general principles of the invention and therefore includes such departures from the present disclosure as come within known or customary practice in the art to which the invention pertains, and as may be applied to the central features set forth above, and which fall within the scope of the appended claims.

What is claimed is:

1. A control system for a pivotally actuated tracer having an object engager which traces an object while the object is held in a more-vertical-than-horizontal orientation, said control system comprising:

a signal element generating a signal related to a rotational orientation of the object engager;

a tracer control element applying control signals to said pivotally actuated tracer, which control signals cause the object engager to be pivotally actuated against and along the object to be traced with a biasing force toward said object while the object engager is rotated along the object; and a gravity compensation element operably connected to said signal element and compensating for the effects of gravity on said object engager by causing said trace control element to apply said control signals in such a way that said tracer exerts a pivoting force on said object engager which varies depending on the rotational orientation of said object engager to keep the biasing force substantially constant along said object.

2. The control system of claim 1, wherein said object to be traced is a lens or a lens pattern;

wherein said tracer control element is adapted to apply said control signals so that said biasing force is applied radially inwardly with respect to a rotational axis about which said object engager rotates; and wherein said gravity compensation element is adapted to cause said trace control element to apply said control signals in such a way that said tracer exerts a progressively smaller pivoting force the closer said object engager comes to an uppermost rotational position and a progressively larger pivoting force the closer said object engager comes to a lowermost rotational position.

3. The control system of claim 1, wherein the object to be traced is a lens mount of an eyeglass frame;

wherein said tracer control element is adapted to apply said control signals so that said biasing force is applied in a radially outward direction; and wherein said gravity compensation element is adapted to cause said trace control element to apply said control signals in such a way that said tracer exerts a progressively larger pivoting force the closer said object engager comes to an uppermost rotational position and a progressively smaller pivoting force the closer said object engager comes to a lowermost rotational position.

4. The control system of claim 1, wherein said trace control element and said gravity compensation element are responsive to object type information indicative whether the object being traced is a lens mount of an eyeglass frame, a lens, or a lens pattern;

wherein said tracer control element is adapted to apply said control signals so that said biasing force is applied radially inwardly with respect to a rotational axis about which said object engager rotates when said object type information indicates that the object being traced is a lens or a lens mount and is adapted to apply said control signals so that said biasing force is applied in a radially outward direction with respect to said rotational axis when said object type information indicates that the object being traced is a lens mount of an eyeglass frame; and wherein said gravity compensation element is adapted to cause said trace control element to apply said control signals in such a way that said tracer exerts:

a progressively larger pivoting force the closer said object engager comes to an uppermost rotational position and a progressively smaller pivoting force the closer said object engager comes to a lowermost rotational position, when said object type information indicates that the object being traced is a lens mount of an eyeglass frame; and when said object type information indicates that the object being traced is a lens or a lens pattern, a progressively smaller pivoting force the closer said object engager comes to said uppermost rotational position and a progressively larger pivoting force the closer said object engager comes to said lowermost rotational position.

5. The control system of claim 1, wherein said object to be traced is a lens mount of an eyeglass frame;

wherein said tracer control element is adapted to apply said control signals so that said biasing force is applied in a radially outward direction; and wherein said gravity compensation element is adapted to cause said trace control element to apply said control signals in such a way that said tracer exerts a pivoting force which varies substantially as a function of rotational orientation of the object engager, wherein said function of rotational orientation is:

for rotational orientations from zero to 99 grads, rbias@n= rbias@zero+abs(rbias@100−rbias@zero)*sin(n);

for rotational orientations from 100 to 199 grads, rbias@n= rbias@200+abs(rbias@100−rbias@200)*sin(n);

for rotational orientations from 200 to 299 grads, rbias@n= rbias@200+abs(rbias@300−rbias@200)*sin(n); and for rotational orientations from 300 to 399 grads, rbias@n= rbias@zero+abs(rbias@300−rbias@zero)*sin(n), wherein the 100 grad orientation is defined as the rotational orientation in which the object engager is rotated to its highest position and wherein the 300 grad orientation is defined as the rotational orientation in which the object engager in its lowest position;

wherein n represents the rotational orientation in angular units, rbias@n represents the pivoting force at the rotational orientation n; abs represents an absolute value operation; rbias@zero represents a pivoting force which is emperically determined to provide favorable resistance to object disengagement at the zero grad orientation; rbias@100 represents a pivoting force which is emperically determined to provide favorable resistance to object disengagement at the 100 grad orientation; rbias@200 represents a pivoting force which is emperically determined to provide favorable resistance to object disengagement at the 200 grad orientation; and rbias@300 represents a pivoting force which is emperically determined to provide favorable resistance to object disengagement at the 300 grad orientation.

6. The control system of claim 5, wherein said gravity compensation element is adapted to select values for rbias@n by referencing a look-up table based on a present rotational orientation n.

7. The control system of claim 5, wherein said gravity compensation element is adapted to approximate said function of rotational orientation by treating each of a plurality of intervals of rotational orientations with a single respective value of rbias@n which is representative of actual rbias@n values in that interval, said single respective value of rbias@n for each interval being selectable by the gravity compensation element by reference to a look-up table.

8. A control and data acquisition system for a pivotally actuated tracer having an object engager which traces an object while the object is held in a more-vertical-than-horizontal orientation, said control system comprising:

a signal element generating a signal related to a rotational orientation of the object engager as the object engager is rotated about the object to be traced;

a tracer control element applying control signals to said pivotally actuated tracer, which control signals cause the object engager to be pivotally actuated against and along the object to be traced with a biasing force toward said object while the object engager is rotated along the object;

a gravity compensation element operably connected to said signal element and adapted to compensate for the effects of gravity on said object engager by causing said trace control element to apply said control signals in such a way that said tracer exerts a pivoting force on said object engager which varies depending on the rotational orientation of said object engager to keep the biasing force substantially constant along said object, said biasing force being a sum of the pivoting force and a component of gravitational force on said object engager directed toward said object;

a position monitoring element detecting, while the object engager is rotated, pivot information indicative of how far the object engager has been pivoted and extension information indicative of how far the object engager has been extended from a pivot axis of said tracer, said pivot information and extension information defining polar coordinate information when combined with rotational information indicative of the rotational orientation of the object engager at instances when said pivot information and said extension information are detected; and a conversion element adapted to convert at least one aspect of said polar coordinate information into cylindrical coordinate information.

9. The control and data acquisition system of claim 8, wherein said object to be traced is a lens or a lens pattern;

wherein said tracer control element is adapted to apply said control signals so that said biasing force is applied radially inwardly with respect to a rotational axis about which said object engager rotates; and wherein said gravity compensation element is adapted to cause said trace control element to apply said control signals in such a way that said tracer exerts a progressively smaller pivoting force the closer said object engager comes to an uppermost rotational position and a progressively larger pivoting force the closer said object engager comes to a lowermost rotational position.

10. The control and data acquisition system of claim 8, wherein the object to be traced is a lens mount of an eyeglass frame;

wherein said tracer control element is adapted to apply said control signals so that said biasing force is applied in a radially outward direction; and wherein said gravity compensation element is adapted to cause said trace control element to apply said control signals in such a way that said tracer exerts a progressively larger pivoting force the closer said object engager comes to an uppermost rotational position and a progressively smaller pivoting force the closer said object engager comes to a lowermost rotational position.

11. The control and data acquisition system claim 8, wherein said trace control element and said gravity compensation element are responsive to object type information indicative whether the object being traced is a lens mount of an eyeglass frame, a lens, or a lens pattern;

wherein said tracer control element is adapted to apply said control signals so that said biasing force is applied radially inwardly with respect to a rotational axis about which said object engager rotates when said object type information indicates that the object being traced is a lens or a lens mount and is adapted to apply said control signals so that said biasing force is applied in a radially outward direction with respect to said rotational axis when said object type information indicates that the object being traced is a lens mount of an eyeglass frame; and wherein said gravity compensation element is adapted to cause said trace control element to apply said control signals in such a way that said tracer exerts:

a progressively larger pivoting force the closer said object engager comes to an uppermost rotational position and a progressively smaller pivoting force the closer said object engager comes to a lowermost rotational position, when said object type information indicates that the object being traced is a lens mount of an eyeglass frame; and when said object type information indicates that the object being traced is a lens or a lens pattern, a progressively smaller pivoting force the closer said object engager comes to said uppermost rotational position and a progressively larger pivoting force the closer said object engager comes to said lowermost rotational position.

12. The control and data acquisition system of claim 8, wherein said object to be traced is a lens mount of an eyeglass frame;

wherein said tracer control element is adapted to apply said control signals so that said biasing force is applied in a radially outward direction; and wherein said gravity compensation element is adapted to cause said trace control element to apply said control signals in such a way that said tracer exerts a pivoting force which varies substantially as a function of rotational orientation of the object engager, wherein said function of rotational orientation is:

for rotational orientations from zero to 99 grads, rbias@n= rbias@zero+abs(rbias@100−rbias@zero)*sin(n);

for rotational orientations from 100 to 199 grads, rbias@n= rbias@200+abs(rbias@100−rbias@200)*sin(n);

for rotational orientations from 200 to 299 grads, rbias@n= rbias@200+abs(rbias@300−rbias@200)*sin(n); and for rotational orientations from 300 to 399 grads, rbias@n= rbias@zero+abs(rbias@300−rbias@zero)*sin(n), wherein the 100 grad orientation is defined as the rotational orientation in which the object engager is rotated to its highest position and wherein the 300 grad orientation is defined as the rotational orientation in which the object engager in its lowest position;

wherein n represents the rotational orientation in angular units, rbias@n represents the pivoting force at the rotational orientation n; abs represents an absolute value operation; rbias@zero represents a pivoting force which is empirically determined to provide favorable resistance to object disengagement at the zero grad orientation; rbias@100 represents a pivoting force which is empirically determined to provide favorable resistance to object disengagement at the 100 grad orientation; rbias@200 represents a pivoting force which is empirically determined to provide favorable resistance to object disengagement at the 200 grad orientation; and rbias@300 represents a pivoting force which is empirically determined to provide favorable resistance to object disengagement at the 300 grad orientation.

13. The control and data acquisition system of claim 12, wherein said gravity compensation element is adapted to select values for rbias@n by referencing a look-up table based on a present rotational orientation n.

14. A control system for controlling the movement of a pivotally actuated tracer having an object-engaging element about the periphery of an object held in a more-vertical-than-horizontal orientation comprising:

a controller for moving said object-engaging element about said periphery and applying a pivotal force against said object;

a detector generating a signal indicative of the location of said engager on said periphery; and a compensator operably connected to said controller and to said detector for varying said pivotal force in response to said signal.

15. A method of tracing an object comprising the steps of:

holding the object in a more-vertical-than-horizontal orientation;

providing a pivotally actuated tracer having an object-engager; and holding the object engager against the object with a substantially constant force while moving said object-engager about the periphery of the object.

16. The method of claim 15 wherein the step of holding the object-engager against the object with a substantially constant force while moving said object-engager about the periphery of the object comprises the step of compensating for the effect of gravity on said object-engager.

17. The method of claim 15 wherein the step of holding the object-engager against the object with a substantially constant force while moving said object-engager about the periphery of the object comprises the step of varying the force applied to said tracer as said object-engager moves about the periphery of the object.

18. The method of claim 15 including the additional step of determining the rotational orientation of the object-engager.

19. A control and data acquisition system comprising:

a pivotally actuated tracer having an object engager for tracing an object held in a more-vertical-than-horizontal orientation;

a signal element generating a signal related to a rotational orientation of the object engager as the object engager is rotated about the object to be traced;

a tracer control element applying control signals to said pivotally actuated tracer, said control signals causing the object engager to pivot against and along the object to be traced with a biasing force;

a gravity compensation element operably connected to said signal element for compensating for the effect of gravity on said object engager by causing said trace control element to exert a pivoting force on said object engager, said force being dependent upon the rotational orientation of said object engager, to keep the biasing force substantially constant along said object;

a position monitoring element detecting, while the object engager is rotated, pivot information indicative of how far the object engager has been pivoted and extension information indicative of how far the object engager has been extended from a pivot axis of said tracer, said pivot information and extension information defining polar coordinate information when combined with rotational information indicative of the rotational orientation of the object engager at instances when said pivot information and said extension information are detected; and a conversion element adapted to convert at least one aspect of said polar coordinate information into cylindrical coordinate information.

* * * * *